US005652038A

United States Patent [19]

Geren

[11] Patent Number: 5,652,038

[45] Date of Patent: Jul. 29, 1997

[54] YARN AND TUFTED FABRIC FOR USE IN A BATHROOM RUG

[75] Inventor: Michael W. Geren, Rocky Face, Ga.

[73] Assignee: Springs Industries, Inc., Fort Mill, S.C.

[21] Appl. No.: 501,608

[22] Filed: Jul. 12, 1995

[51] Int. Cl.[6] ..... B32B 3/02

[52] U.S. Cl. ..... 428/92; 428/97; 57/239

[58] Field of Search ..... 428/92, 97; 57/239

[56] References Cited

U.S. PATENT DOCUMENTS

| | | | |
|---|---|---|---|
| 3,010,179 | 11/1961 | Thal . | |
| 4,045,605 | 8/1977 | Breens et al. | 428/92 |
| 4,103,054 | 7/1978 | Okamoto et al. . | |
| 4,323,612 | 4/1982 | van Issum . | |
| 4,340,631 | 7/1982 | Endo et al. . | |
| 4,415,611 | 11/1983 | Yamagata et al. | 428/92 |
| 4,546,020 | 10/1985 | Sakai et al. | 428/92 |
| 4,668,553 | 5/1987 | Scott et al. | 428/92 |
| 4,712,366 | 12/1987 | Tsujimoto et al. . | |
| 4,820,566 | 4/1989 | Heine et al. . | |
| 4,845,934 | 7/1989 | Bauer . | |
| 5,055,333 | 10/1991 | Heine et al. . | |
| 5,306,536 | 4/1994 | Moretz et al. . | |

FOREIGN PATENT DOCUMENTS

| | | | |
|---|---|---|---|
| 3-27149 | 2/1991 | Japan | 428/92 |
| 3-241058 | 10/1991 | Japan | 428/92 |
| 5-247834 | 9/1993 | Japan | 428/92 |

OTHER PUBLICATIONS

Translation of JP 3–27149 Feb. 5, 1991.
Translation of JP 3–241058 Oct. 28, 1991.
Translation of JP 5–247834 Sep. 24, 1993.

*Primary Examiner*—Terrel Morris
*Attorney, Agent, or Firm*—Bell Seltzer Park & Gibson

[57] ABSTRACT

A tufted fabric and yarn for use therein which is suitable for fabrication into a highly absorbent and quick drying bathroom rug. The fabric includes a primary backing material and yarn tufts secured in the backing material and forming a raised surface on one side of the backing material. Each of the tufts and the yarn for forming of such tufts includes hydrophilic microdenier filaments in an end of less than 500 denier for wicking and distributing moisture throughout the raised surface of the tufted fabric and hydrophobic tufting denier filaments in an end of more than 500 denier for providing resiliency, bulk and strength to the tufted fabric.

18 Claims, 3 Drawing Sheets

YARN AND TUFTED FABRIC FOR USE IN A BATHROOM RUG

FIELD OF THE INVENTION

This invention relates to a tufted fabric suitable for use as a highly absorbent and quick drying bathroom rug and a yarn suitable for use in such tufted fabric.

BACKGROUND OF THE INVENTION

Bathroom rugs have conventionally been constructed of a tufted fabric having a raised surface of yarn tufts on one side of a backing material. Nylon, or in some cases other synthetic filaments such as polyester, have predominately been utilized as the yarns for tufting the bathroom rug fabric because of the resiliency, bulk and strength provided by this type of yarn.

Yarn manufacturers have engineered tufting denier nylon filaments, which are normally sold in filament ends of nominal 1000 to 1200 denier, to have the luster level and hand of cotton, while retaining the resiliency, strength and performance of nylon. However, the absorbency of cotton was not obtained in the yarn and they are considered hydrophobic. When tufted fabrics utilizing these tufting denier hydrophobic nylon or other synthetic yarns were fabricated into bathroom rugs, absorbency and drying rate of water or moisture dropped on these rugs from a person stepping out of a shower or bath tub created problems of the water pooling in certain areas of the bathroom rug and thus required an inordinate period of time for drying of the rug.

More recently, hydrophilic microdenier nylon has been developed by yarn producers to have absorbency characteristics of cotton or other natural fibers. This newly developed microdenier nylon has been sold in filament ends of about 90 denier for use in garment fabrics, particularly for sports apparel, to wick moisture from one side of the fabric to the other side of the fabric away from the skin of the wearer or to disburse the moisture throughout the fabric for quick drying of the fabric and to keep the side of the fabric in contact with the skin of the wearer in a dryer state. This microdenier nylon has never been considered practical for use in tufted fabrics of the type being considered by this invention since it would be inordinately expensive to produce a filament end in the tufting denier range of more than 500 and preferably of about 1000 to 1200.

OBJECT AND SUMMARY OF THE INVENTION

It is therefore the object of this invention to provide a tufted fabric and a yarn for use in such tufted fabric which provides increased absorbency and quick drying over prior tufted fabrics used for bathroom rugs, while retaining the resiliency, bulk and strength of prior bathroom rugs.

It has been found by this invention that this object may be accomplished by providing a tufted fabric comprising a primary backing material and yarn for forming tufts secured in the backing material and forming a raised surface on one side of the backing material. Each of the yarn tufts includes hydrophilic microdenier filaments in an end of less than 500 denier for wicking and distributing moisture throughout the raised surface of the fabric and hydrophobic tufting denier filaments in an end of more than 500 denier for providing resiliency, bulk and strength to the fabric. While both the hydrophobic tufting denier filament ends and the hydrophilic microdenier filament ends have been available from yarn producers, no one has heretofore suggested or considered the possibility of combining these ends into a yarn suitable for tufting into a fabric which provides the absorbency and moisture distribution of cotton or other natural fibers, while retaining the strength, resiliency and performance of nylon, polyester or other synthetics.

BRIEF DESCRIPTION OF THE DRAWINGS

Some of the objects and advantages of this invention have been set forth, other advantages and details of this invention and a preferred embodiment thereof may be seen from the more detailed description to follow, when taken in conjunction with the accompanying drawings, in which.

DETAILED DESCRIPTION OF PREFERRED EMBODIMENT OF THE INVENTION

Figure 1:
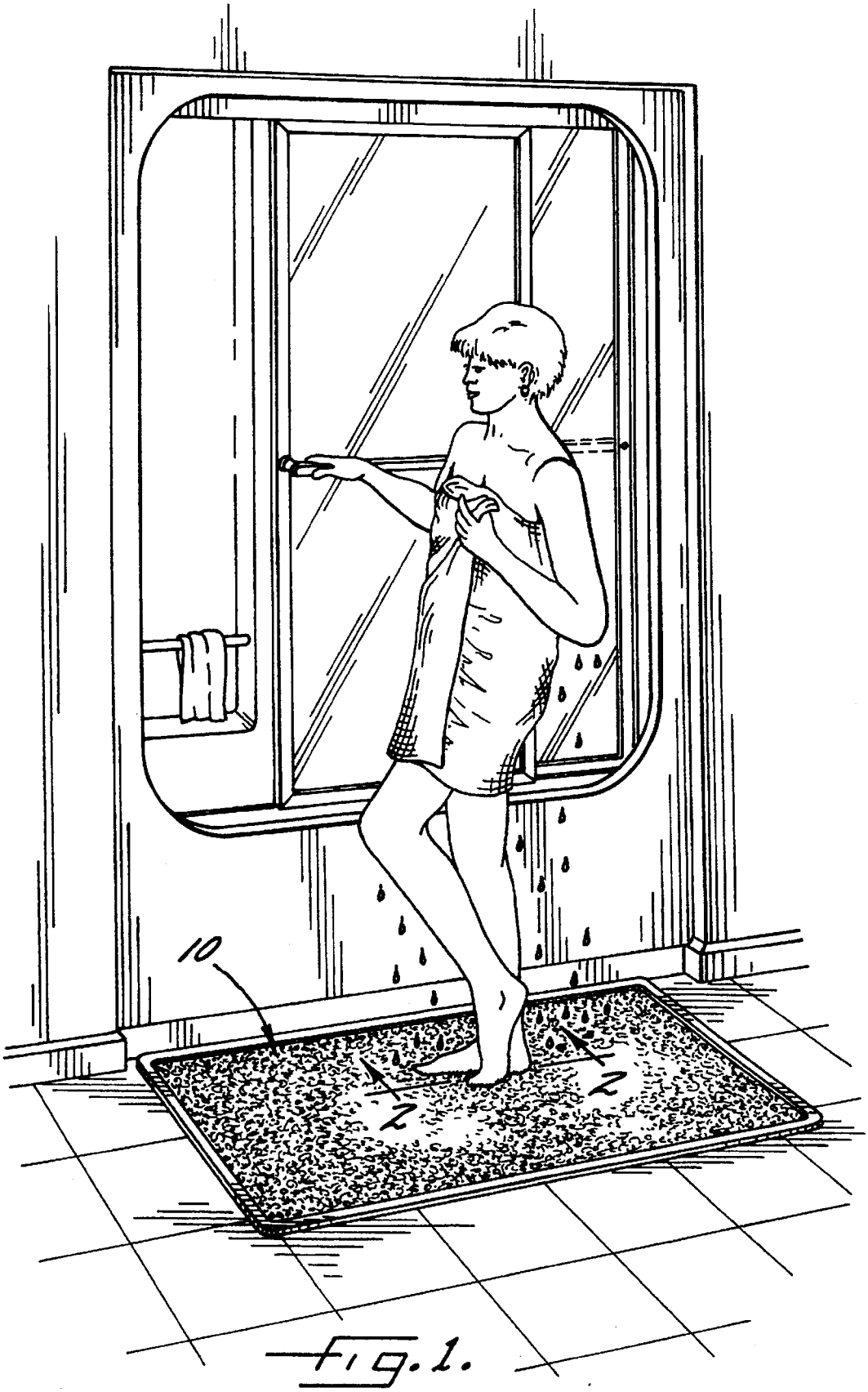
FIG. 1 is a perspective view illustrating the tufted fabric of this invention fabricated into a bathroom rug and being used by a user stepping out of a shower.
Figure 2:
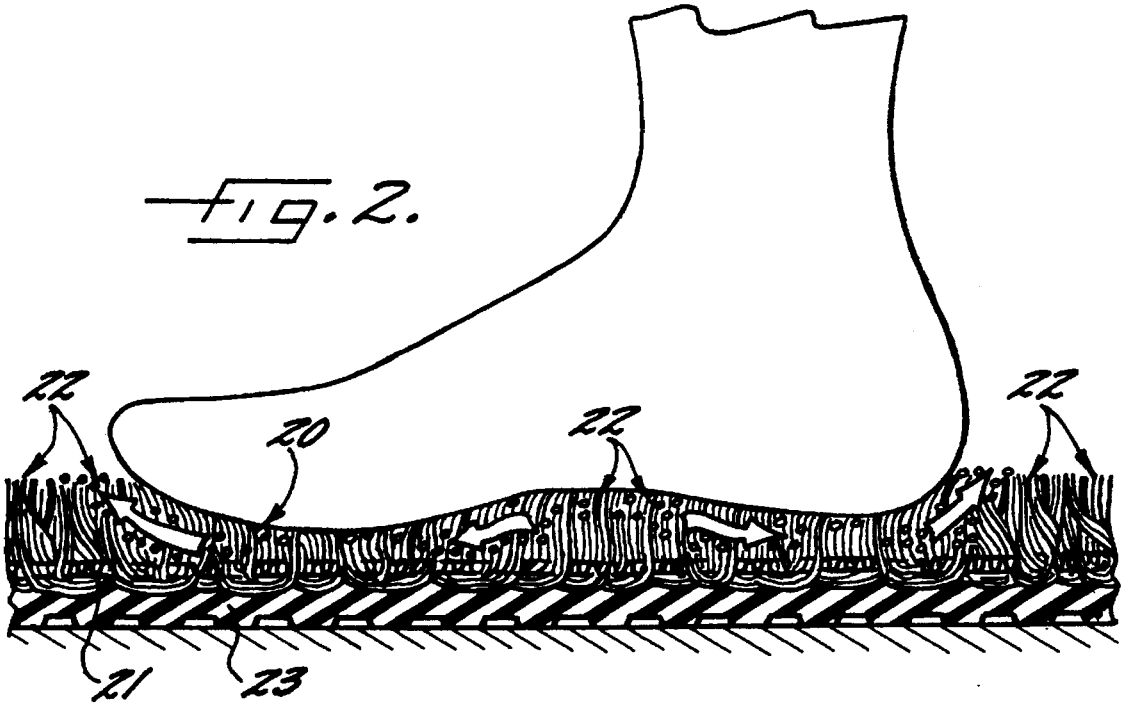
FIG. 2 is an enlarged cross-sectional view, taken generally along the line 2—2 of FIG. 1 and showing the foot of a user in position on the rug after stepping out of a shower.
Figure 3:
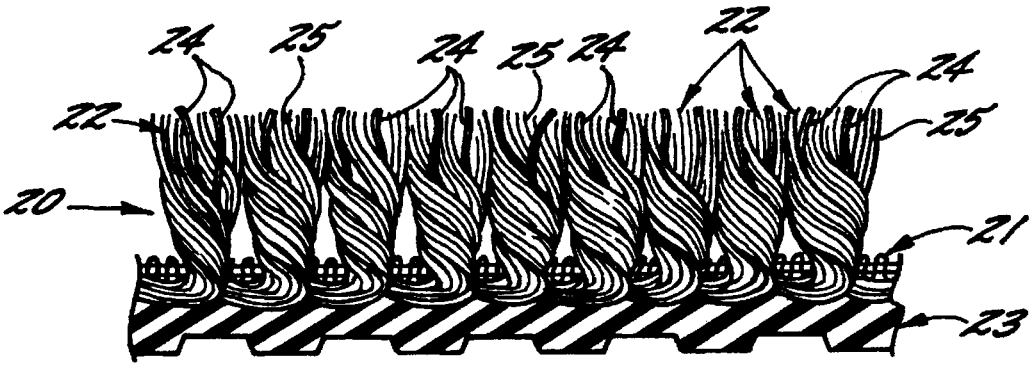
FIG. 3 is an enlarged sectional view of a portion of the tufted fabric utilized for the bathroom rug of FIGS. 1 and 2.
Figure 4:
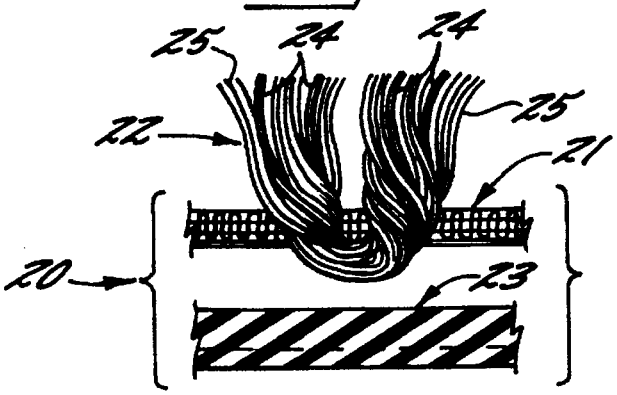
FIG. 4 is a sectional view of one of the tufts utilized in the tufted fabric of FIG. 3 and in partially exploded condition.
Figure 5:
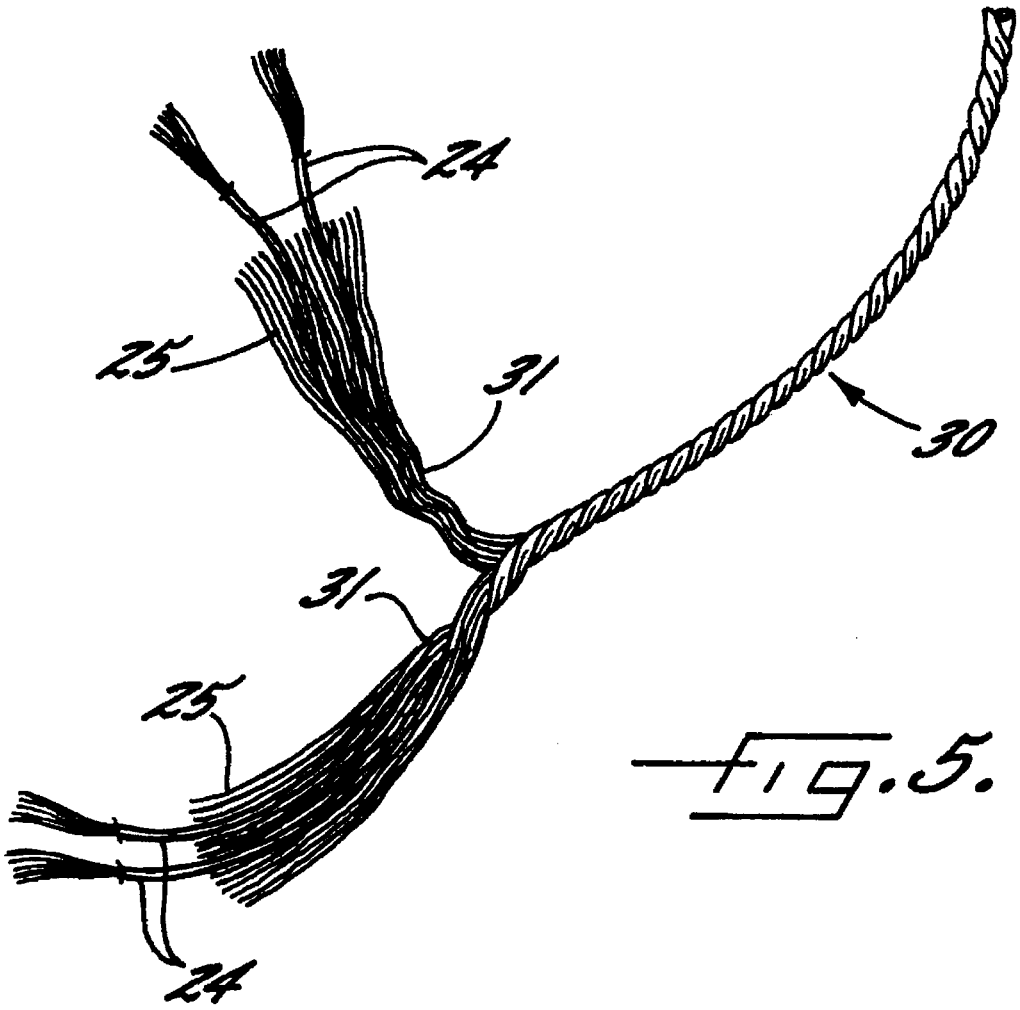
FIG. 5 is a perspective view of a yarn utilized for forming the tufts in the fabric of FIGS. 3 and 4 and showing the yarn in an untwisted condition at one end thereof for illustration purposes.

Referring now the drawings, there is shown in FIG. 1 a bathroom rug, generally indicated at 10, which utilizes the tufted fabric 20 and tufting yarn 30 of this invention. The bathroom rug 10, as shown in FIG. 1, is adapted for stepping on by a user when coming out of a bath tub or shower and, thus, receives moisture or water thereon which drips from the user.

Referring now more specifically to FIGS. 2–5, the tufted fabric 20 which is suitable for use in the bathroom rug 10 comprises a primary backing material 21 and yarn tufts 22. These yarn tufts 22 form a raised surface on one side of the backing material and are preferably secured in place by a latex coating 23 on the other side of the backing material 21, as may be clearly seen in FIGS. 2–4.

Each of the tufts 22 includes hydrophilic microdenier filaments in an end 24 of less than 500 denier for wicking and distributing moisture throughout the raised surface of the fabric 20 and hydrophobic tufting denier filaments in an end 25 of more than 500 denier for providing resiliency, bulk and strength to the fabric 20.

Preferably, the hydrophilic filaments forming the ends 24 comprise microdenier nylon having a denier per filament of about 2.5 and which is commercially available from a number of yarn producers including Allied Signal and DuPont. The hydrophobic filament ends 25 are also preferably nylon of the tufting denier range having a denier per filament of about 9 and may be commercially obtained from a number of yarn producers including also Allied Signal and DuPont.

It has been found by this invention that ends of hydrophilic microdenier nylon filaments having a denier of approximately 90 and ends of hydrophobic tufting denier nylon filaments having a denier of approximately 1200 can be utilized in this invention and are readily commercially available from yarn producers. It is also possible and within the scope of this invention to utilize other synthetic filaments as both the hydrophilic microdenier filaments and the hydrophobic tufting denier filaments, including polyester or the like.

In development of this invention, tests were conducted to determine the desired blend of the hydrophilic microdenier filaments and the hydrophobic tufting denier filaments. As a result of these tests, it was determined that the desired properties of wicking and distributing moisture leveled off at about 13% hydrophilic microdenier filaments and 87% hydrophobic tufting denier filaments. Accordingly, when utilizing off the shelf conventionally available microdenier nylon filament ends of about 90 denier and hydrophobic tufting denier filament ends of about 1200, it was determined that each of the yarn tufts 22 should comprise at least one yarn end 31 of about 1380 denier having therein at least two hydrophilic microdenier filament ends 24 and one hydrophobic tufting denier filament end 25. It was further determined that, in order to obtain the desired bulk in each of the tufts 22, that the yarn 30 used for forming the tufts 22 should include two of the yarn ends 31 twisted together.

As a specific example of the manufacture of a tufting yarn, a tufted fabric and a bathroom rug in accordance with this invention, the following is given.

Hydrophobic nylon filaments, 1202/denier singles BCF, are purchased from any suitable yarn producer, such as Allied Signal. Hydrophilic filaments in the form of 90/denier singles BCF are purchased from any yarn producer, such as Allied Signal. These filament ends are processed by a yarn converter into a finished yarn.

The yarn converter combines one end of the 1202/denier single BCF hydrophobic nylon filaments with two ends of the 90/denier single BCF nylon hydrophilic filaments creating a 1382/denier single BCF yarn end. Two such yarn ends are then twisted together at a twist rate of 3.5 turns per inch to form the tufting yarn. This tufting yarn is then heat set to retain the twist level characteristics and to finish the tufting yarn.

Fabric is then tufted on a conventional 12 foot wide ⅛ gage tufting machine having a pile height for the tufts of about 11/16 inch at a rate of 34 oz/square yard and with a stitch rate of 6.825 stitches/inch. A 150 inch wide primary backing is utilized and may be a 24×13 plane woven polypropylene material with a weight of 3.3 oz/square yard and may be purchased from any number of suppliers.

After tufting, the fabric is processed through a latex coater to establish a finish coating on the back of the fabric. The finish coating may be a formulation of natural rubber and other synthetics. The coating is provided to lock the yarn tufts into the primary backing and establish a non-skid surface for the finished bath rug. The finished latex coating weight may be 22 oz/square yard. Total weight of the product may be 59.3 oz/square yard.

After coating, the tufted fabric may be cut into specified sizes for the final sewing operation of the bathroom rugs. Sizes may be 21×34 or 34×21, 17×24, 24×40, 22×60, etc. After being cut into these sizes, the bathroom rugs are finished in greige formed by applying a dyeable non-woven nylon binding around the outside edges of the bathroom rug. This binding may be sewn with a 400/denier nylon thread. The greige rugs are then processed through a dye operation to provide color to the rugs as desired.

Thus, this invention has provided a yarn 30 and a tufted fabric 20 which are suitable for use in constructing a highly absorbent and quick drying bathroom rug 10 and which retains the resiliency, bulk and strength of prior bathroom rugs.

This invention has been described in considerable detail with respect to its preferred embodiment. However, variations and modifications can be made within the spirit and scope of this invention as described in the foregoing specification and as defined in the following claims.

What is claimed is:

1. A tufted fabric suitable for use as a highly absorbent and quick drying bathroom rug and comprising a primary backing material and yarn tufts secured in said backing material and forming a raised surface on one side of said backing material, each of said tufts including hydrophilic microdenier filaments in an end of less than 500 denier for wicking and distributing moisture throughout said raised surface of said fabric and hydrophobic tufting denier filaments in an end of more than 500 denier for providing resiliency, bulk and strength to said fabric.

2. A tufted fabric, as set forth in claim 1, in which said hydrophilic filaments comprise microdenier nylon and said hydrophobic filaments comprise tufting denier nylon.

3. A tufted fabric, as set forth in claim 1 or 2, in which said microdenier filaments comprise a filament end of approximately 90 denier and said tufting denier filaments comprise a filament end of approximately 1200 denier.

4. A tufted fabric, as set forth in claim 1 or 2, in which each of said tufts comprises approximately 13% hydrophilic microdenier filaments.

5. A tufted fabric, as set forth in claim 1 or 2, in which each of said yarn tufts comprise at least one yarn end having therein at least two said hydrophilic microdenier filament ends and one said hydrophobic tufting denier filament end.

6. A tufted fabric, as set forth in claim 5, in which each of said yarn tufts comprises two of said yarn ends twisted together.

7. A tufted fabric suitable for use as a highly absorbent and quick drying bathroom rug and comprising a primary backing material and yarn tufts secured in said backing material and forming a raised surface on one side of said backing material, each of said tufts includes two hydrophilic microdenier nylon filament ends of approximately 90 denier for wicking and distributing moisture throughout said raised surface of said fabric and a hydrophobic tufting denier nylon filament end of approximately 1200 denier for providing resiliency, bulk and strength to said fabric, each of said tufts comprising approximately 13% hydrophilic microdenier nylon filaments.

8. A tufted fabric, as set forth in claim 7, in which each of said yarn tufts comprises two yarn ends twisted together and each of said yarn ends having therein at least two of said hydrophilic microdenier nylon filament ends and one of said hydrophobic tufting denier nylon filament end.

9. A tufted fabric, as set forth in claim 1, 2, 7 or 8, in which said fabric further includes a latex coating on the other side of said backing material for securing said yarn tufts in said backing material.

10. A tufted fabric, as set forth in claim 9, in which said backing material comprises a woven material.

11. A yarn suitable for use as tufts in a highly absorbent and quick drying fabric having resiliency, bulk and strength for use as a bathroom rug, said yarn comprising hydrophilic microdenier filaments in an end of less than 500 denier for wicking and distributing moisture and hydrophobic tufting denier filaments in an end of more than 500 denier for providing resiliency, bulk and strength.

12. A yarn, as set forth in claim 11, in which said hydrophilic filaments comprise microdenier nylon and said hydrophobic filaments comprise tufting denier nylon.

13. A yarn, as set forth in claim 11 or 12, in which said microdenier filaments comprise a filament end of approximately 90 denier and said tufting denier filaments comprise a filament end of approximately 1200 denier.

14. A yarn, as set forth in claim 11 or 12, in which hydrophilic microdenier filaments comprise 13% of said yarn.

15. A yarn, as set forth in claim 11 or 12, wherein said yarn comprises at least two said hydrophilic microdenier filament ends and one said hydrophobic tufting denier filament end.

16. A yarn, as set forth in claim 11 or 12, in which said yarn comprises two yarn ends, each of said yarn ends including at least two said hydrophilic microdenier filament ends and one said hydrophobic tufting denier filament ends.

17. A yarn of approximately 1380 denier suitable for use as tufts in a highly absorbent and quick drying fabric having resiliency, bulk and strength for use as a bathroom rug, said yarn comprising two hydrophilic nylon filament ends of approximately 90 denier for wicking and distributing moisture and a hydrophobic nylon filament end of approximately 1200 denier for providing resiliency, bulk and strength.

18. A yarn suitable for use as tufts in a highly absorbent and quick drying fabric having resiliency, bulk and strength for use as a bathroom rug, said yarn comprising two yarn ends twisted together in which each of said yarn ends includes two hydrophilic microdenier nylon filament ends of approximately 90 denier for wicking and distributing moisture and a hydrophobic tufting denier nylon filament end of approximately 1200 denier for providing resiliency, bulk and strength.

* * * * *